US007538299B2

(12) United States Patent
Spence et al.

(10) Patent No.: US 7,538,299 B2
(45) Date of Patent: May 26, 2009

(54) MEDIA CONDITIONER MODULE

(75) Inventors: James J. Spence, Honeoye Falls, NY (US); David R. Kretschmann, Penfield, NY (US); David M. Thompson, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 310 days.

(21) Appl. No.: 11/535,629

(22) Filed: Sep. 27, 2006

(65) Prior Publication Data

US 2008/0083726 A1 Apr. 10, 2008

(51) Int. Cl.
*F27B 9/06* (2006.01)
*B41J 2/01* (2006.01)

(52) U.S. Cl. ..... 219/388; 219/216; 347/102; 347/104; 347/17; 347/18

(58) Field of Classification Search ..... 219/216, 219/388; 347/102, 104, 17, 18
See application file for complete search history.

(56) References Cited

U.S. PATENT DOCUMENTS 5,633,668 A * 5/1997 Schwiebert et al. ..... 347/102
6,032,004 A 2/2000 Mirabella, Jr. et al.
6,536,863 B1 * 3/2003 Beauchamp et al. ..... 347/17
6,913,354 B2 * 7/2005 Rasmussen et al. ..... 347/102
2002/0075371 A1 6/2002 Beehler et al.
2003/0137573 A1 7/2003 Rasmussen et al.

* cited by examiner

*Primary Examiner*—Shawntina Fuqua
(74) *Attorney, Agent, or Firm*—Gibb I.P. Law Firm, LLC

(57) ABSTRACT

Embodiments herein include a media conditioning module for being connected between a media source supplying sheets of media and a printing device. The media conditioning module is adapted to remove moisture from the sheets of media received from the media source before the sheets of media are supplied to the printing device. The media conditioning module comprises a heater and a cooler. The heater has manifolds positioned to supply heated air to both sides of the sheets of media as the sheets of media pass through the media conditioning module. The cooler is positioned to supply non-heated air to both sides of the sheets of media as the sheets of media pass through the media conditioning module. The heater is positioned with respect to the cooler such that the sheets of media pass by the heater before the sheets of media pass by the cooler.

20 Claims, 4 Drawing Sheets

MEDIA CONDITIONER MODULE

CROSS REFERENCE TO RELATED APPLICATIONS

The present application is related to pending U.S. patent application Ser. No. 11/327,633, filed on Jan. 6, 2006 to Michael N. Soures et al., entitled "Automatically Variably Heated Airflow For Separation Of Humid Coated Paper Print Media". The foregoing application is assigned to the present assignee, and is incorporated herein by reference in its entirety.

BACKGROUND AND SUMMARY

Embodiments herein include a media conditioning module for being connected between a media source supplying sheets of media and a printing device. The media conditioning module is adapted to remove moisture from the sheets of media received from the media source before the sheets of media are supplied to the printing device.

In one embodiment, the media conditioning module comprises a heater and a cooler. The heater can have manifolds (ducts) positioned to supply heated air to both sides of the sheets of media as the sheets of media pass through the media conditioning module. The cooler comprises fans and is positioned to supply non-heated air to, or remove air and moisture from, one or both sides of the sheets (and the region surrounding the sheets of media) as the media sheets pass through the media conditioning module. The heater is positioned with respect to the cooler such that the sheets of media pass by the heater before the sheets of media pass by the cooler.

The heated air has a higher temperature than the non-heated air. In addition, the media conditioning module includes a media path comprising nip rollers and baffles. However, the media path does not block the heated air and instead the baffles include openings adjacent the heater such that the heater is allowed to blow the heated air directly on the sheets of media as the sheets of media pass along the media path. The cooler and the heater can comprise heating and cooling ducts. The heating ducts are connected to any conventional thermal heating device. Further, the cooler also can comprise manifolds (ducts) positioned to supply non-heated air to both sides of the sheets of media as the sheets of media pass through the media conditioning module. The fans can be reversed to allow the cooler to remove the air and moisture from the sheets and the region surrounding the sheets.

In a different embodiment, the media path comprises baffles and the heater is connected to the baffles and positioned to supply heated air to both sides of the sheets of media as the sheets of media pass through the media conditioning module. The baffles include openings adjacent the heater such that the heater blows the heated air directly on the sheets of media as the sheets of media pass along the media path.

These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

Modular printer/copier systems can selectively include different modules, such as paper supplies, image output terminals (IOT), and finisher modules. However, some of the modules, such as the image output terminal, can suffer from degraded performance under specific conditions. For example, some image output terminals have a limited latitude for transferring images onto lightweight media. Lightweight media can be of any relative light weight, such as in the 40-45 lbs (60-67 gsm) range, however, the embodiments herein are not limited to any specific weight or the media. Lightweight stock is gauged for its application by the media's ppi (pages per inch) requirement, which relates to the media's paper thickness and how many sheets can be bound in a 1 inch thickness. As a resultant of paper thickness and moisture content of the media, the beam strength of the media is compromised, and this can cause paper corrugation, and induce errors within the transfer zone. Testing has demonstrated that a reduction in paper moisture content improves paper beam strength, which in turn reduces paper corrugation and increases resitivity, which improves transfer stability.

When heating media, such as paper or other porous materials, moisture evaporates and steam vapor is produced. A major contributor to media handling problems is caused by such moisture being introduced onto the paper transport baffles. Due to the packaging constraints of the feeder module, the heating process will occur in a horizontal orientation, thus creating a source of trapped moisture between the media and the baffles.

Figure 1:
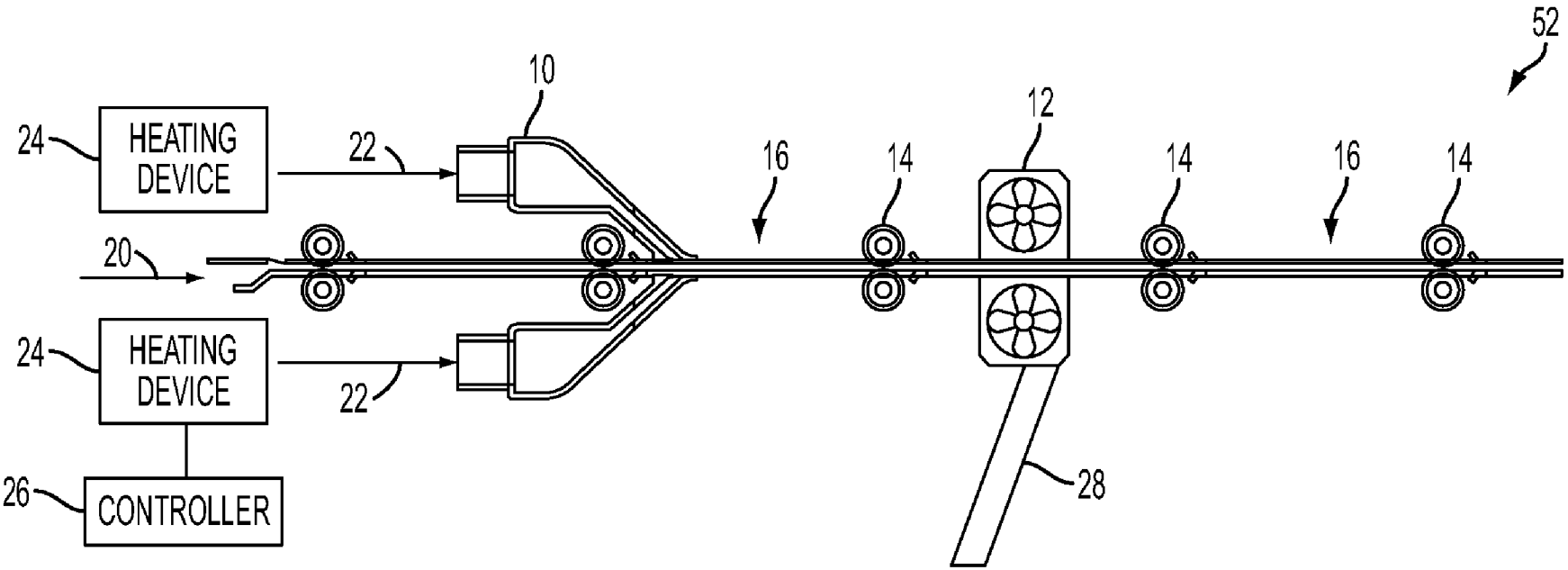
FIG. 1 is a schematic side-view diagram of a media conditioning module according to embodiments herein.

One counter measure (solution) to this phenomenon employed by embodiments herein is the usage of a cooling zone (cooler 12, FIG. 1). In one example, the parameter of the cooler 12 can be set to match the same constraint for the heater 10. Further, serial (multiple) cooling zones 12 can be included on the media path 14, 16, as shown in FIG. 2.

Figure 2:
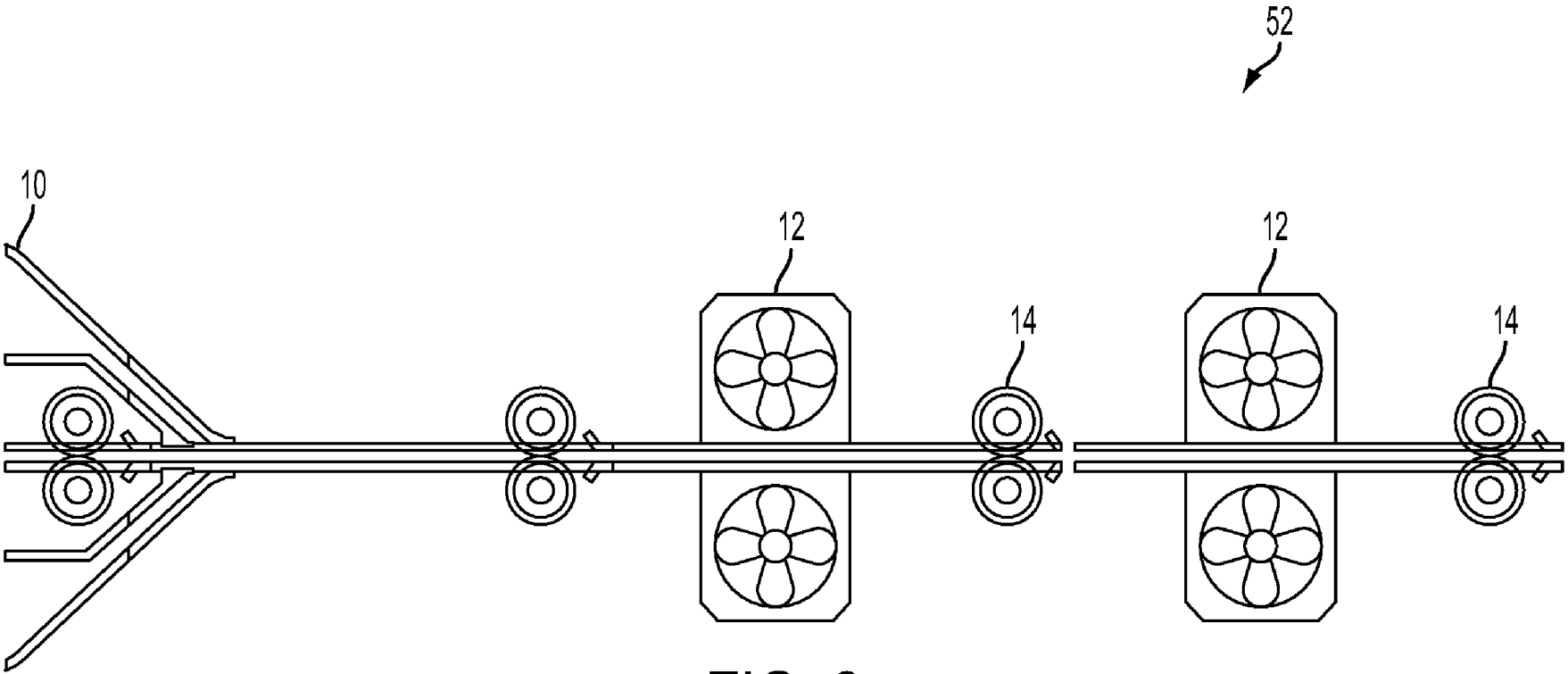
FIG. 2 is a schematic side-view diagram of a media conditioning module according to embodiments herein.

With the structure shown in FIGS. 1 and 2, media is transported through a heated zone 10 (hot air impingement curtain) that delivers airflow at a predetermined temperature onto the media. The hot air allows for sufficient dwell in which paper moisture content is reduced. Downstream from the heated zone is a cooling and air evacuation device 12 that allows for evaporated moisture to escape.

More specifically, FIG. 1 illustrates a media conditioning module 52 that has a structure that allows it to be connected between a media source (supplying sheets of media 20) and a printing device. The media conditioning module 52 is adapted to remove moisture from the sheets of media 20 received from the media source before the sheets of media 20 are supplied to the printing device.

In one embodiment, the media conditioning module 52 comprises a heater 10 and a cooler 12, each having upper and lower manifolds. The heater 10 has manifolds positioned to supply heated air to both sides of the sheets of media 20 as the sheets of media 20 pass through the media conditioning module 52. The cooler 12 can comprise the same form of manifolds used for the heater or can comprise fans positioned directly adjacent the media path to supply non-heated cooling air to both sides of the sheets of media 20 as the sheets of media 20 pass through the media conditioning module 52. Whether the fans of the cooler 12 are connected to manifolds or not, the fans can operate to blow cooling air toward the media or the fans can be reversed to draw air and moisture away from the media and the region of the media. The heater 10 is positioned with respect to the cooler 12 such that the sheets of media 20 pass by the heater 10 before the sheets of media 20 pass by the cooler 12.

Figure 3:
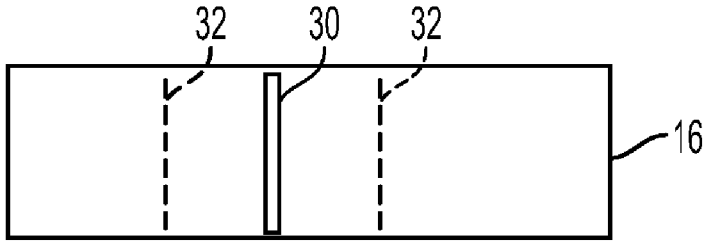
FIG. 3 is a schematic top-view diagram of a baffle used with embodiments herein.

The heated air has a higher temperature than the non-heated air. For example, the non-heated air can be at ambient, room temperature, or the temperature of air within the printer/copier which can range from 5° C. to 40° C., or higher. To the contrary, the heated air is substantially warmer than the non-heated air (e.g., heated by at least 10° C.) and can range from 40° C. to the ignition temperature of the printing media. For example, if standard paper is used, the heated air could comprise a temperature between 50° C. and the ignition temperature of paper (350° C.), and more particularly, between 100° C. and 150° C. The embodiments herein are not limited to any specific temperature ranges, as the foregoing are merely examples used to illustrate the embodiments herein. In addition, the media conditioning module 52 includes a media path comprising nip rollers 14 and guides or baffles 16. However, the baffles 16 do not block the heated air and instead include at least one opening 30 (FIG. 3) adjacent the heater 10 such that the heater 10 is allowed to blow the heated air directly on the sheets of media 20 as the sheets of media 20 pass along the media path. The cooling zones 12 can also comprise transport baffles 16 (FIG. 3) that are slotted in an orientation that will be non-intrusive to the media handling capabilities of the transport baffles. Further, the baffles 16 can be formed with ribs 32 to minimize the amount of surface cohesion between the paper and metal surface. Through the operation of the heater or cooler, a cross process convective air flow will be packaged above and below the media surfaces. This air flow creates an entrained flow pattern that allows for the moisture to escape the containment between the baffle gaps.

The heater 10 comprises heating ducts connected to any conventional forced air thermal heating device 24 that produces the hot air flow 22. The heating device 24 can comprise any conventional device, such as a fan that provides air flow across a resistive heater element, these air heaters are commonly available, as are blowers, sensors and controls that can be packaged within the heating device 24. The unit 24 can be, for example, positioned behind the heater and a hose or hoses can be routed to the upper and lower manifolds of the heater 10.

In a more specific embodiment, the heater 10 comprises stationary manifolds positioned to supply heated air to both sides of the sheets of media 20 as the sheets of media 20 pass through the media conditioning module 52. Further, the cooler 12 also comprises stationary manifolds positioned to supply non-heated air to both sides of the sheets of media 20 as the sheets of media 20 pass through the media conditioning module 52.

In a further embodiment, the cooler 12 can include the same type of manifolds as those used in the heater. Such manifolds can similarly be positioned to blow/remove air to/from both sides of the sheets of media 20. Alternatively, differently shaped ducting 28 can be connected to the cooler 12. The ducting (manifolds) is not limited to the specific examples shown in the drawings and, instead, the ducting can take on any shape necessary to accommodate spacing and size constraints of the device in question. Similarly, the fans 12 can be placed at either end of the ducting, again depending upon design requirements. The cooler 12 blows air and moisture from the sheets of media 20 into the ducting and the ducting is shaped and positioned to direct the air and moisture away from the sheets of media 20 to a location outside the device or at least far enough away from the media region and baffles to prevent the return of moisture to the media region.

The actual temperatures used in the heater 10 will vary from application to application and can even be varied depending upon the type of media being processed. The heat process configuration used to deliver moisture reduction in paper disclosed herein is non-contact convection and, therefore, does not cause the paper deformation that can be caused by heated rollers and other contact based heaters. Paper can be transported through the feeder module bypass transport at a different speed than that used within the IOT module to allow for sufficient heating and cooling. The space used to achieve optimum dwell or heat transfer will be constrained. As velocity and distance are known, time for transfer can be calculated. As a resultant of limited dwell zone for effective heat transfer and individual heat absorption rate of the paper, variables of air flow and temperature delivered onto the paper will change dependent upon the heat absorption rate of the media.

Therefore, a controller 26 can control the temperature of the hot air flow 22 to change with each different characteristic (weight, size, moisture content, transport speed, etc.) of the media passing through the conditioner module 52. Because different types of media will possess varying heat absorption rates, unique set points for temperature and air flow settings to achieve desired moisture reduction can be used. Such setting can be determined through environmental testing to validate the image quality associated with moisture content reduction of the paper, for each different media characteristic the apparatus is likely to encounter. Thus, the embodiments herein can, but do not need to, rely upon a previously created control scheme and interface in which a user can potentially input media set points.

Figure 4:
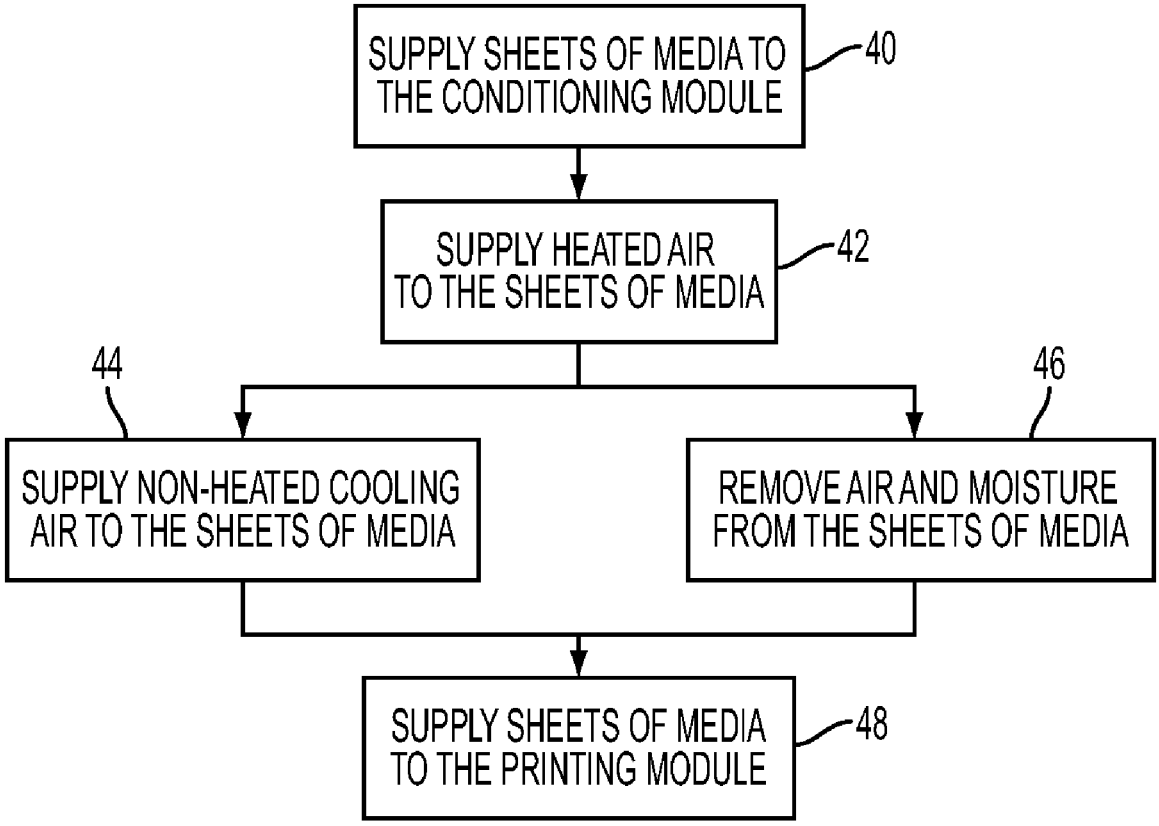
FIG. 4 is an illustration of the methodology of embodiments herein shown in flowchart form.

The methodology of embodiments herein is shown in flowchart form in FIG. 4. More specifically, in item 40, the method supplies sheets of media from the media source 50 to the media conditioning module 52. Again, the media conditioning module 52 is adapted to remove moisture from the sheets of media received from the media source before the sheets of media are supplied to the printing device 54. Next, in item 42, the method supplies heated air to both sides of the sheets of media as the sheets of media pass through the media conditioning module 52. In alternative embodiments, either non-heated cooling air can be supplied to at least one side of the sheets of media (item 44) or air and moisture can be removed (item 46) from at least one side of the sheets of media (and the area surrounding the sheets of media) as the sheets of media pass through the media conditioning module. In either case, the sheets of media are heated before the sheets of media are cooled or the air and moisture are removed. Again, the heating can comprise directing the heated air from a heating element to the sheets of media using ductwork and the cooling can comprise using at least one fan. In embodiments herein, the heating comprises convection heating which avoids contact with the media and associated media deformation. In item 48, the sheets of media are sent from the media conditioning module to a printing device.

Further, the present embodiments can comprise a completely new module or a retrofit to a previous module. More specifically, the structure shown in FIGS. 1 and 2 can be integrated into a convective conditioning unit within the bypass transport of a feeder module.

Figure 5:
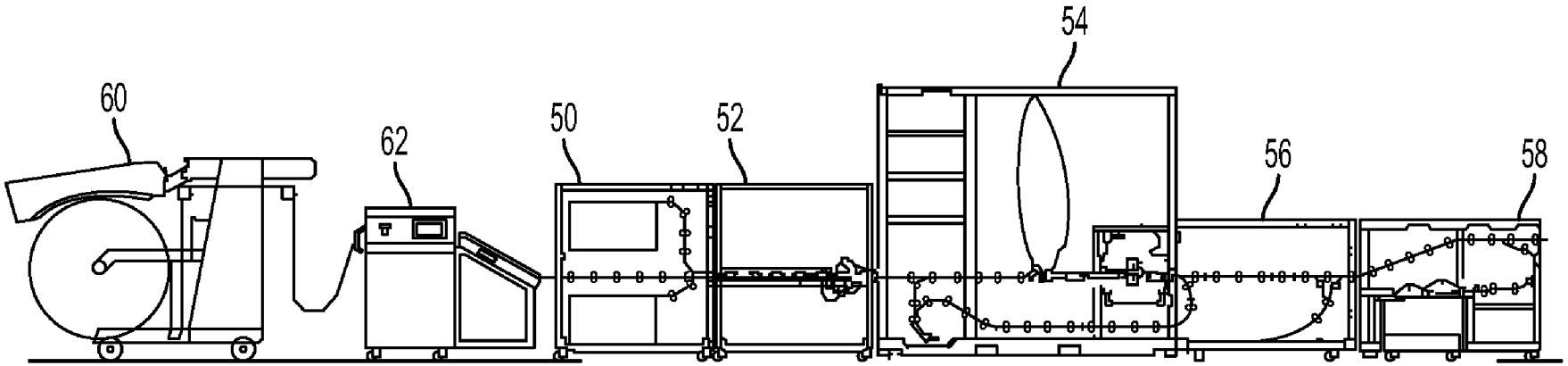
FIG. 5 is a schematic side-view diagram of printing assemblies using the media conditioning module according to embodiments herein.

As shown more specifically in FIG. 5 the conditioning module 52 can comprise an in-line module 52 positioned prior to an imaging module 54. The conditioning module 52 will induce a drying effect onto the media, resulting in a moisture reduction in the paper. This media conditioning module 52 can be packaged within existing modules, such a feeder module, and utilize various existing technologies. These technologies can be aligned to the critical parameters associated with achieving a targeted moisture content of the media resulting in a desired image quality.

In FIG. 5, a first document processing system in which embodiments herein can be used, includes a bulk paper supply 60, a paper cutter 62, a media source 50 with multiple paper trays, and a feeder/media conditioning unit 52 (that includes the structures shown in FIGS. 1 and 2) that conditions and feeds the media into an image output terminal (IOT) 54. The image output terminal 54 includes an integrated marking engine. In addition, an output transport module 56 and a finisher module 58 can be included as additional modules. The finisher 58 can include, for example, main job output trays. Depending on a document processing job description and on the capabilities of the finisher 58, one or both of the main job output trays may collect loose pages or sheets, stapled or otherwise bound booklets, shrink wrapped assemblies or otherwise finished documents. The finisher 58 receives sheets or pages from the image output terminal 54 via the output transport module 56 and processes the pages according to a job description associated with the pages or sheets and according to the capabilities of the finisher 58.

A controller within the IOT 54 orchestrates the production of printed or rendered pages, their transportation over the various path elements, and their collation and assembly as job output by the finisher 58. The produced, printed or rendered pages may include images transferred to the document processing system via a telephone communications network, a computer network, computer media, and/or images entered through an image input device. For example, rendered or printed pages or sheets may include images received via facsimile, transferred to the document processing system from a word processing, spreadsheet, presentation, photo editing or other image generating software, transferred to a document processor over a computer network or on a computer media, such as, a CD ROM, memory card or floppy disc, or may include images generated by the image input device of scanned or photographed pages or objects. Additionally, on an occasional, periodic, or as needed or requested basis, the controller (not shown) may orchestrate the generation, printing or rendering of test, diagnostic or calibration sheets or pages. As will be explained in greater detail below, such test, diagnostic or calibration sheets may be transferred, manually or automatically, to the image input device, which can be used to generate computer readable representations of the rendered test images. The computer readable representations may then be analyzed by the controller, or some auxiliary device, to determine image consistency information, and, if necessary, adjust some aspect of the image rendering system in a manner predetermined or known to make an improvement in, or achieve, image consistency. For example, electrophotographic, xerographic, or other rendering technology actuators may be adjusted. Alternatively, image path data may be manipulated to compensate or correct for some aspect of the rendering or marking process based on the analysis of the computer readable representations of the test images.

The word "printer" or "image output terminal" as used herein encompasses any apparatus, such as a digital copier, bookmaking machine, facsimile machine, multi-function machine, etc. which performs a print outputting function for any purpose. The details of printers, printing engines, etc. are well-known by those ordinarily skilled in the art and are discussed in, for example, U.S. Pat. No. 6,032,004, the complete disclosure of which is fully incorporated herein by reference. The embodiments herein can encompass embodiments that print in color, monochrome, or handle color or monochrome image data. All foregoing embodiments are specifically applicable to electrostatographic and/or xerographic machines and/or processes.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof. Unless specifically defined in a specific claim itself, steps or components of the invention should not be implied or imported from any above example as limitations to any particular order, number, position, size, shape, angle, color, or material.

What is claimed is:

1. An apparatus comprising:

a media conditioning module comprising:

a heater positioned to blow heated air directly on both sides of sheets of media as said sheets of media pass through said media conditioning module; and a cooler positioned to supply non-heated air to both sides of said sheets of media as said sheets of media pass through said media conditioning module, wherein said heater is positioned with respect to said cooler such that said sheets of media pass by said heater before said sheets of media pass by said cooler.

2. The apparatus according to claim 1, wherein said heated air has a higher temperature than said non-heated air.

3. The apparatus according to claim 1, wherein said heater comprises a heating element and ductwork directing said heated air from said heating element to said sheets of media.

4. The apparatus according to claim 1, wherein said cooler comprises at least one fan and ductwork directing said non-heated air to said sheets of media.

5. The apparatus according to claim 1, wherein said heater comprises a convection heater and does not contact said media.

6. An apparatus comprising:

a media conditioning module adapted to be connected to a media source supplying sheets of media and adapted to be connected to a printing device, wherein said media conditioning module is adapted to remove moisture from said sheets of media received from said media source before said sheets of media are supplied to said printing device, wherein said media conditioning module comprises:

a heater positioned to blow heated air directly on both sides of said sheets of media as said sheets of media pass through said media conditioning module; and a cooler positioned to remove air and moisture from both sides of said sheets of media as said sheets of media pass through said media conditioning module, wherein said heater is positioned with respect to said cooler such that said sheets of media pass by said heater before said sheets of media pass by said cooler.

7. The apparatus according to claim 6, wherein said heated air has a higher temperature than said non-heated air.

8. The apparatus according to claim 6, wherein said heater comprises a heating element and ductwork directing said heated air from said heating element to said sheets of media.

9. The apparatus according to claim 6, wherein said cooler comprises at least one fan and ductwork directing said air and moisture away from said sheets of media.

10. The apparatus according to claim 6, wherein said heater comprises a convection heater and does not contact said media.

11. An apparatus comprising:

a media conditioning module adapted to be connected to a media source supplying sheets of media and adapted to be connected to a printing device, wherein said media conditioning module is adapted to remove moisture from said sheets of media received from said media source before said sheets of media are supplied to said printing device, wherein said media conditioning module comprises:

a media path comprising baffles, a heater connected to said baffles and positioned to supply heated air to both sides of said sheets of media as said sheets of media pass through said media conditioning module, wherein said baffles include openings adjacent to said heater such that said heater blows said heated air directly on said sheets of media as said sheets of media pass along said media path; and a cooler positioned to remove air and moisture from both sides of said sheets of media as said sheets of media pass through said media conditioning module, wherein said heater is positioned with respect to said cooler such that said sheets of media pass by said heater before said sheets of media pass by said cooler.

12. The apparatus according to claim 11, wherein said heated air has a higher temperature than said non-heated air.

13. The apparatus according to claim 11, wherein said heater comprises a heating element and ductwork directing said heated air from said heating element to said sheets of media.

14. The apparatus according to claim 11, wherein said cooler comprises at least one fan and/or ductwork directing said air and moisture away from said sheets of media.

15. The apparatus according to claim 11, wherein said baffles comprise ridges in a region of said heater such that said sheets of media do not adhere to said baffles.

16. A method comprising:

supplying sheets of media from a media source to a media conditioning module, wherein said media conditioning module is adapted to remove moisture from said sheets of media received from said media source before said sheets of media are supplied to a printing device;

blowing heated air directly on both sides of said sheets of media as said sheets of media pass through said media conditioning module; and one of:

supplying non-heated air to at least one side of said sheets of media; and removing air and moisture from both at least one side of said sheets of media as said sheets of media pass through said media conditioning module, wherein said sheets of media are heated before said sheets of media are cooled or said air and moisture are removed; and supplying said sheets of media from said media conditioning module to a printing device.

17. The method according to claim 16, wherein said heated air has a higher temperature than said non-heated air.

18. The method according to claim 16, wherein said heating comprises directing said heated air from a heating element to said sheets of media using ductwork.

19. The method according to claim 16, wherein said cooling comprises using at least one fan directing said non-heated air to said sheets of media and removing said air and moisture from said sheets of media.

20. The method according to claim 16, wherein said heating comprises convection heating which avoids contact with said media.

* * * * *